US005839725A

United States Patent [19]

Conway

[11] Patent Number: 5,839,725

[45] Date of Patent: Nov. 24, 1998

[54] APPARATUS AND METHOD OF PLAYING A BOARD GAME SIMULATING TEAMS PLAYING IN A TOURNAMENT

[76] Inventor: Andrew D. Conway, 1310 Cedar Lake Rd., Lake Villa, Ill. 60046

[21] Appl. No.: 740,304

[22] Filed: Oct. 28, 1996

[51] Int. Cl.[6] ..... A63F 3/00

[52] U.S. Cl. ..... 273/244; 273/259; 273/277; 273/146

[58] Field of Search ..... 273/244, 247, 273/259, 277, 146

[56] References Cited

U.S. PATENT DOCUMENTS 3,970,313 7/1976 Montemayor ..... 273/243

4,201,386 5/1980 Seale et al. ..... 273/236

4,524,975 6/1985 Caughie et al. ..... 273/247

*Primary Examiner*—Benjamin H. Layno

*Attorney, Agent, or Firm*—Paul H. Gallagher

[57] ABSTRACT

A board that has markings for placement of teams in tournament style. Teams are identified by chips bearing the names of the teams. Dice are provided for rolling to determine wins, and rates of advancement. Also cards are provided with instructions, for adding or subtracting score points. The dice are of different kinds, having different numbers of sides having numerals and blanks for producing different probabilities according to seeded and unseeded teams respectively.

19 Claims, 3 Drawing Sheets

REFEREE CARDS

LIFE CARDS

TEAM DOCTOR CARDS

APPARATUS AND METHOD OF PLAYING A BOARD GAME SIMULATING TEAMS PLAYING IN A TOURNAMENT

SUMMARY OF THE INVENTION

The invention resides in the field of games that are many times known as board games, that is, it includes a playing board, and pieces to be used therewith, to be moved, or read for instructions, or to determine positions or locations of the players.

The game is adapted to sports games and particularly team games. Because of possibility of confusion between the players of the present game and actual teams, represented, and to facilitate reference to them, the former are referred to herein as board players and the latter as teams. As will be understood, in certain cases, both names may apply to the same entity.

The game is designed for playing by an indeterminate number of teams, i.e. two or more, up to a maximum found practical, which in the present case can be as many as sixteen.

The pieces are separate and apart from the playing board, and a main object of the game is to advance the teams positions, and to acquire numerical scores of the teams or board players, to eventually terminate in a single winner, or champion. The game is of tournament style.

The game provides various steps involved in actual sports games, such as identification of the teams, random selection of the teams, placing the teams in bracketed positions, and thereby giving them seeded positions, determining wins and losses, infractions of rules, and other items, and plays.

The steps of the game also include ruling of referees, appeals of the rulings, penalties, and additions to and subtractions from a gross score.

The steps and maneuvers of the individual teams and the relations between the teams and games played are determined by handling the pieces on the board, including blind selection of chips, rolling of dice, and drawing of cards sequentially from a stack.

The seeding of certain teams is determined by blind drawing, this seeding step providing different odds affecting the progress of the teams through the tournament.

Special dice are provided which are effective for giving odds for advancement of teams according to probabilities existing between actual teams such as percentages resulting from games played in a season. The special dice have respectively different numbers of indicating sides to give score numbers similar to the seeding of the teams.

DETAILED DESCRIPTION OF THE DRAWINGS

Figure 1:
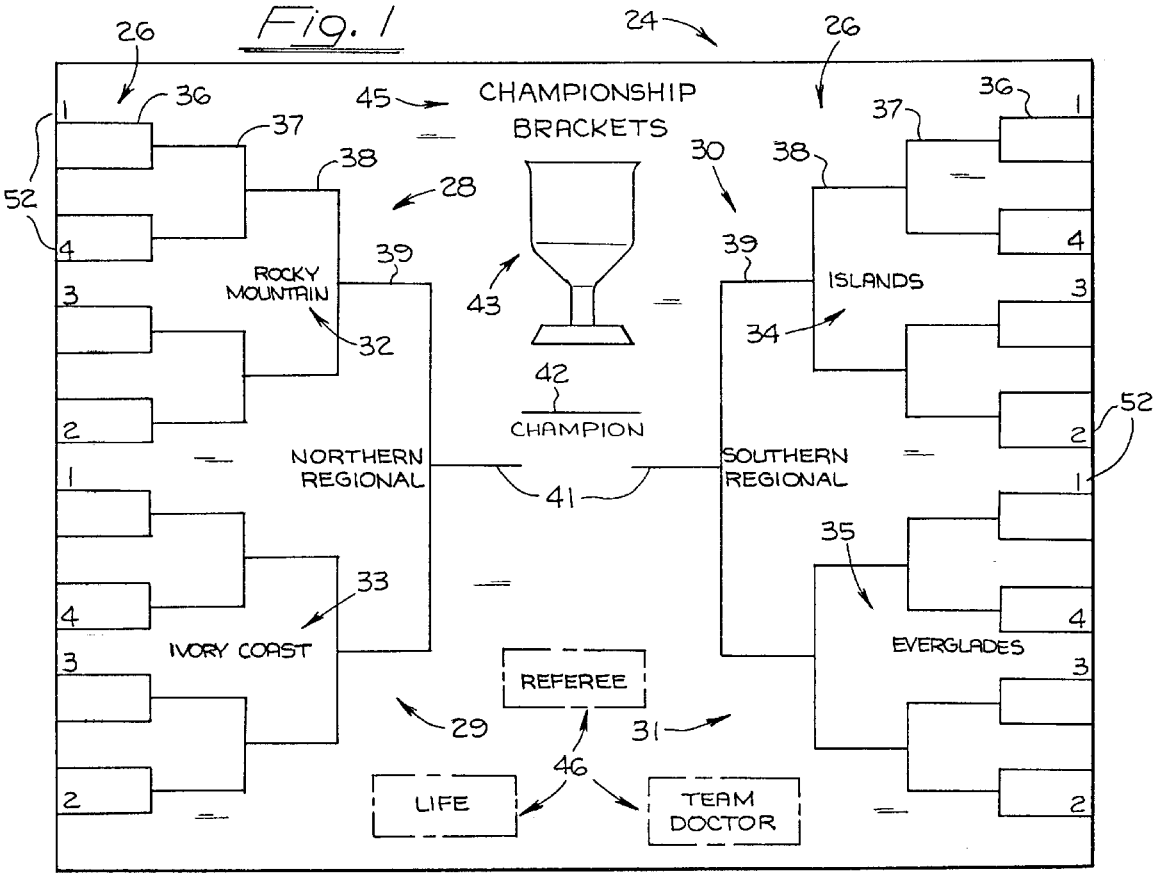
FIG. 1 is a face view of the board of the game.

FIG. 1 is a face view of the board 24 of the game, and on its front surface has game position markings 26, in this case arranged in four Conferences 28, 29, 30, 31, suitably labeled as to name.

The board is marked in a conventional way for tournament play, including outer tiers of lines 36 representing Round 1 games. Inwardly of these tiers are other tiers 37 representing semi-finals of the Conferences. Inwardly from the latter tiers, are tiers 38 representing finals of the Conferences, semi-finals of the Region. Inwardly of the latter tiers, are additional tiers 39 representing Regional finals, and again inwardly of the latter are lines 41 representing the two contestants in the finals for the championship represented by the line 42 at the center. As in all tournaments, the progress is that the teams winning in the first round go to the second round, etc., in an elimination program.

Figure 20:
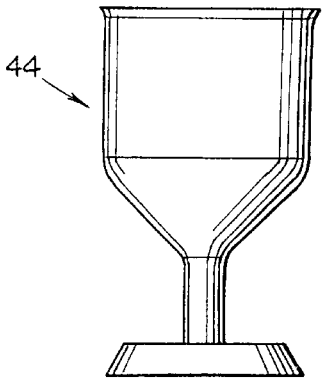
FIG. 20 is a view of a trophy cup.

The board also is provided with a representation 43 of a trophy, won by the champion; a physical trophy itself is shown at 44, FIG. 20, as an item separate from the board. The title of the game is imprinted on the board as indicated at 45, and at the bottom of the board are names 46 and surrounding areas for locating stacks of cards bearing the same names, to be described below.

Included are many individual physical pieces used in playing the game, and at least certain ones being placed on the board to show the progress of the game, such as the wins and losses of the teams. Other pieces may be used for drawing for position, and move, etc., and still other pieces contain special instructions.

Figure 2:
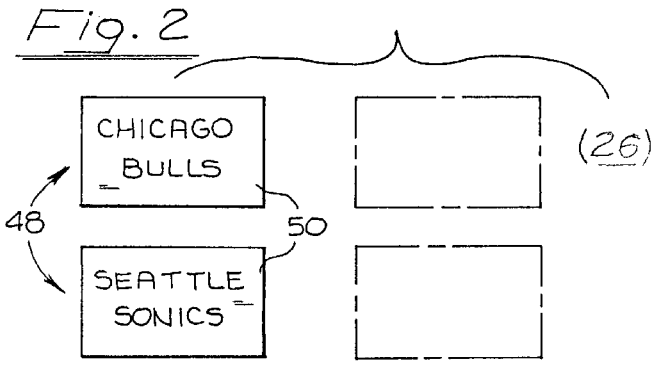
FIG. 2 shows chips representing teams playing in the tournament, these chips being moved along and stay on the board as the playing progresses.

As noted above, the game may be played as associated with any of various activities, especially in the sports world, and the game as here represented is designed for a basketball tournament, and the game utilizes the names of presently known basketball teams. In playing the game, these teams are selected in a manner described hereinbelow, and they are represented physically by chips 48, in FIG. 2, the chips bearing the names 50 of the respective teams. These chips are similar to each other in physical construction.

The game is set up for the inclusion of 32 teams, 16 in each of the Round 1, tiers 36, such number of teams being very common, there being no byes.

The game also takes into consideration the fact of preference of certain teams, expected to win more often, representing teams in actual play that have won higher percentages through a season, for example. The teams are seeded to represent higher winning records, as in actual real life play, and in Round 1 they are seeded so that the higher winners are matched against lower winners, so as to preserve the probability of the better teams reaching the finals. The seeding is indicated at 52 by numbers, 1, 2, 3, 4, in each Conference. These seeding numbers are assigned only to half of the brackets or positions, the remaining ones not being numbered, and the teams corresponding to the latter thus not being seeded.

The game of the invention includes a number of pieces separate from the board found practical or convenient according to the set-up of 32 teams, but of course different numbers of pieces may be used if desired.

Figure 3:
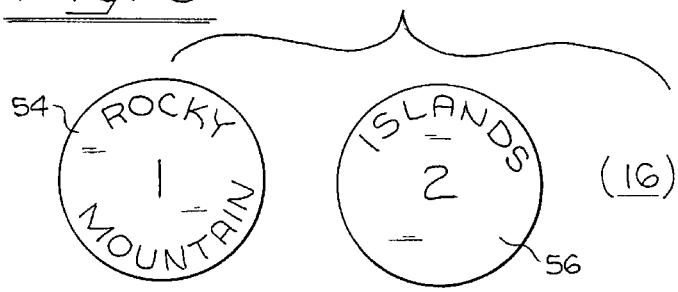
FIG. 3 shows other chips that are drawn, representing specific seeding of teams.

FIG. 3 shows chips 54, 56 utilized in determining the positions, or seeding. These chips may be simple round disks bearing the names of the Conferences and the seeding numbers. For example the chip 54 includes the Conference Rocky Mountain, and seed #1. The next chip, 56 bears the Conference Islands and seed #2. There are four of these chips for each of the Conferences, bearing the name of the Conference, and respectively the seedings 1, 2, 3, 4. There are 16 of these chips, four being used in each conference.

Figure 4:
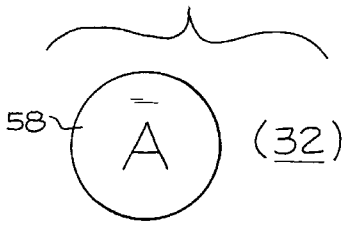
FIG. 4 shows chips indicating appeal.

The game also provides for appeals by the teams of the decisions rendered, in a manner described hereinbelow. Such appeals are represented by chips 58 shown in FIG. 4. These chips may be simple round flat disks with the letter A thereon. These are drawn by the board players, as described hereinbelow.

In playing the game, each board player is given a score card 58 (FIG. 16), on which he keeps a running score. The board players acquire scores, in addition to advancing the teams, and in the playing of the game, the players receive instructions for adding to and subtracting from the scores, as referred to again hereinbelow.

To be placed on the board, at the bottom thereof, are three stacks of reference cards 60, 61, 62 shown in FIG. 5, which contain instructions to be followed by the teams as described hereinbelow. These cards may be of indeterminate number, such for example as thirty in each stack. On their back side they bear identifying names 64, 65, 66 and are placed over the same names respectively that are imprinted on the board, at 46. The cards are shown face down in FIG. 5, and thus their backsides are exposed, and attention is directed to FIGS. 6, 7, 8 to show the front sides thereof, and the inscriptions imprinted thereon. In FIG. 6 for example a card 60 shows an inscription 68 which is a penalty. Specifically, the infraction is eye gouging and the penalty is subtraction of 4 points from the score count of the team involved in the play. These cards 64 may be provided with a wide variety of inscriptions, as identified at 68', these inscriptions being representative of all the various ones utilized. These inscriptions (in FIG. 6) indicate one favorable ruling, permitting the team to add 3 points to its score count. Others are penalties, which instruct to subtract such points.

Figure 7:
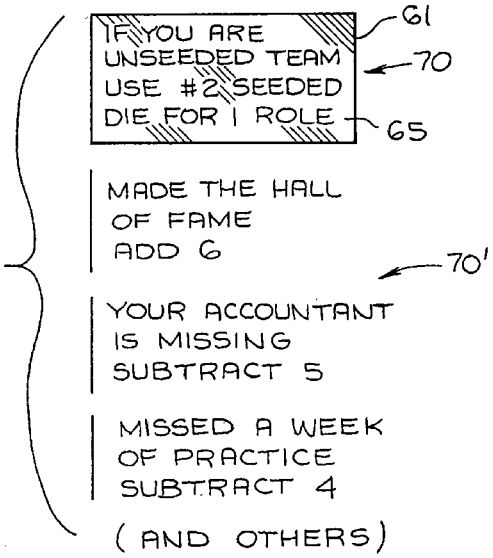
FIG. 7 is a view of a card of a second stack of FIG. 5 showing instructions on representative cards.

FIG. 7 shows a card 61 with an inscription 70 thereon, on its front face, and this figure also shows other inscriptions 70'.

Figure 8:
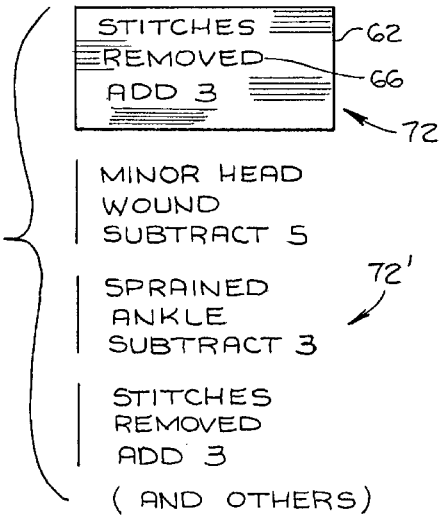
FIG. 8 is a view of a card of another stack of FIG. 5 showing instructions on representative cards.

In a similar manner, FIG. 8 show a TEAM DOCTOR card 62 with an inscription 72 on the face thereof, and this figure also includes additional inscriptions 72' representative of those on all the cards, of that stack, which may be all different.

Figure 5:
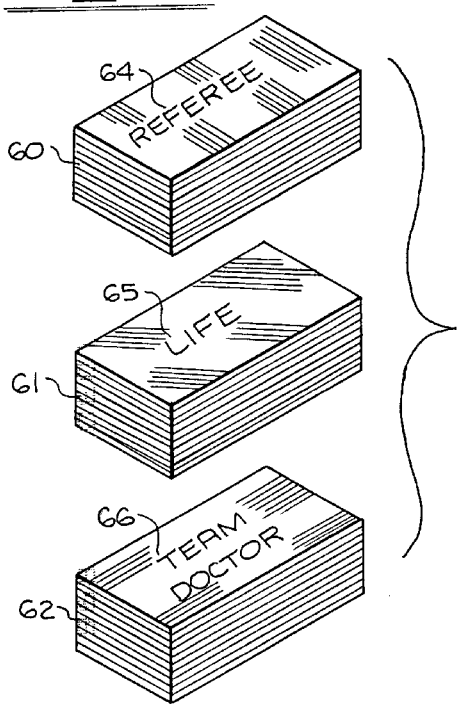
FIG. 5 is a perspective view of three stacks of cards bearing instructions to be followed by the teams.
Figure 6:
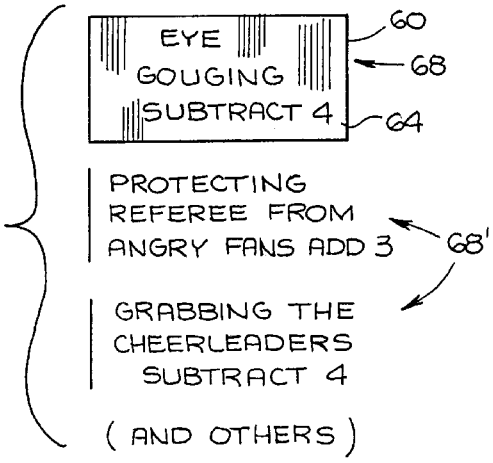
FIG. 6 is a face view of a card of one of the stacks of FIG. 5, and showing inscriptions on representative cards.

The cards 60, 61, 62 are preferably of different colors, such as red, green, blue, as indicated in FIG. 5 to facilitate identification thereof.

Figure 9:
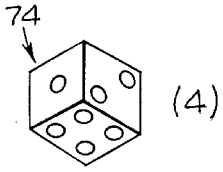
FIG. 9 is a perspective view of a common die.

Used in the game are regular dice 74, one being shown in FIG. 9. This die is a cube, or six-sided, and bears spots in numbers 1–6 respectively. There are four of these regular dice utilized.

Figure 10:
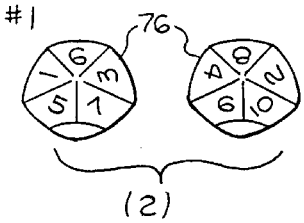
FIG. 10 is a perspective view showing opposite sides of a seeded die #1.

FIG. 10 shows a #1 seeded die, 76. This die has 10 sides and each side bears a number, 1–10. In this figure the two views show opposite sides of a single die. There are two such dice used.

Figure 11:
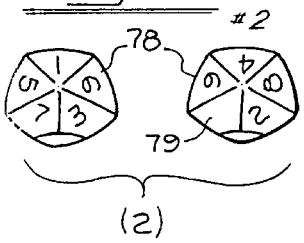
FIG. 11 is a perspective view showing opposite sides of a seeded die #2.

FIG. 11 shows a #2 seeded die, 78, having 10 sides of the same shape and size as the #1 seeded die 76. The die 78 has nine of its sides numbered, 1–9, and has one blank side 79, for changing the odds relative to the die 76 as will be explained below. There are two such dice used.

Figure 12:
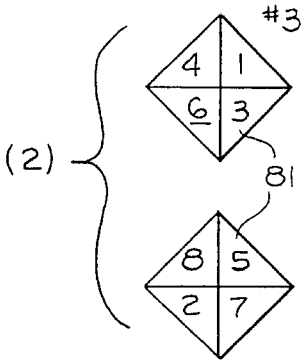
FIG. 12 is a perspective view showing opposite sides of a seeded die #3.

FIG. 12 shows a #3 seeded die 81, which has eight sides and each side bears a number, 1–8. The two views of this figure show opposite sides of a single die. There are two such dice used.

Figure 13:
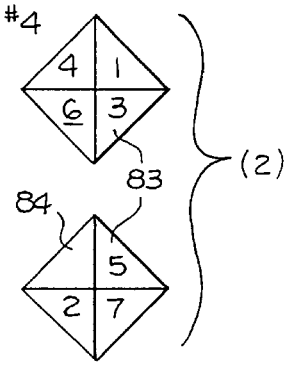
FIG. 13 is a perspective view showing opposite sides of a seeded die #4.

FIG. 13 shows a #4 seeded die 83 of the same shape and size as the die 81. In the present case seven of the eight sides bear numbers, 1–7, and the die has a blank side 84 to change the odds in the rolls, relative to the die 81, in a relationship similar to that between the dice 76, 78. There are two such dice (83) used.

Figure 14:
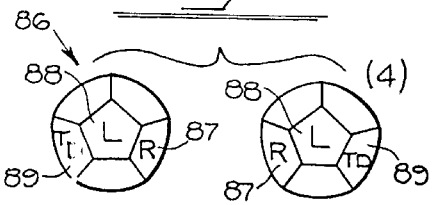
FIG. 14 shows one of two opposite sides of a bracket die.

FIG. 14 shows a bracket die 86 which has twelve sides, and six of the sides 87, 88, 89 bear the letters R, L, TD, respectively representing the names REFEREE, LIFE, TEAM DOCTOR, imprinted on the board. The remaining six sides are blank. Preferably there are four of these dice used.

Figure 15:
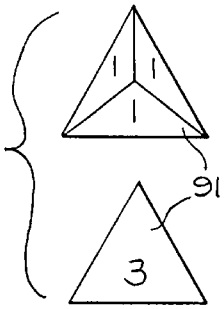
FIG. 15 is a view showing opposite sides of a penalty die.

FIG. 15 shows a penalty die, two of which are provided, and which are identical. In FIG. 15 the upper figure shows the numeral 1 on each of three sides, and the lower figure shows the numeral 3 on the bottom side.

The numerals and letters on the dice may be generically referred to as indicia.

Figure 17:
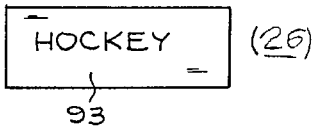
FIG. 17 shows identification chips of teams of a different game.

As noted above, the game may be adapted to and represent different sports. For example, instead of basketball, hockey may be represented, as indicated by the chips 93 in FIG. 17. In this case 32 such chips are provided, for filling all of the Round 1 positions.

Figure 18:
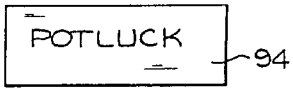
FIG. 18 shows identification chips of teams of still another game.
Figure 19:
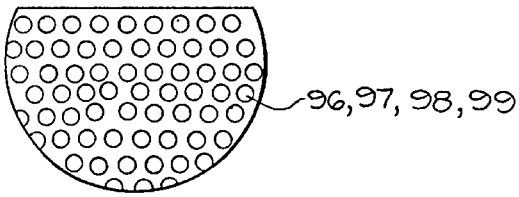
FIG. 19 is a perspective view of a cup used in rolling dice.

Still another feature is represented in FIG. 18. Instead of utilizing the names of presently existing actual teams, fictional names may be used as shown in this figure. These names may of course represent teams in any sport.

For rolling the dice at any of the various steps, dice cups 96, 97, 98, 99 are provided. The board players may use any one desired, for that purpose. The cups are respectively, but not limited to, the shape of golf ball, tennis ball, football helmet, baseball cap. These cups remain unused except in the rolling of the dice.

In FIG. 20 a trophy cup 44 represents the award for the winner. This trophy cup is separate from the board and may be like that (43) shown in FIG. 1. It also serves as one of the game pieces, and may be utilized to place the other pieces that are drawn, therein, and used as a step in the playing of the game.

PLAYING THE GAME

In playing real life sports games, the participating teams are given seeded positions according to their record throughout the season leading up to the tournament, wherein initially the highest seeded team is matched against the lowest seeded team, and progressively throughout the matching step. On the playing board in the present case, FIG. 1, each seeded number 52 is matched with an unseeded team, represented by a blank line. In the present game, the chips 48 (FIG. 2) are placed in the trophy cup 44, and the board players draw these chips from it. There are 32 such chips, as noted, and the board players draw in turn from them, and if the number of board players is less than the number of chips, they continue to draw, in turn, until all of the chips are drawn. These chips show the names of the teams, as indicated, all different.

The next step is to place the seeding chips 54 in the cup, and these are drawn in the same manner as in the case of the team chips, until all are drawn. There are 16 of these chips, representing the four seeded teams in each of the Conferences. Each of the chips bears the name of a Conference, and one of the numerals 1–4. Those that drew these chips then place their teams in the seeded positions indicated, one at a time.

The board players then place their remaining chips 48, that have not been put in seeded positions, on the unseeded positions represented by the blank lines in Round 1. Since the present step possibly involves preference in mating the unseeded teams with the seeded teams, the order of placement of the unseeded teams would be significant, and this order is determined by rolling a pair of regular dice 74, FIG. 9.

The appeal chips 58 are put in a suitable location, which may be in the trophy cup, or on the board, and each board player is given a number of these appeal chips, previously decided upon. For example, each board player may be given 3 of them. The use of these will be referred to below.

At the beginning of the game, the stacks of reference cards 60, 61, 62 are placed in their respective positions at the bottom of the board, at the positions indicated. They are placed face down, the rear sides being exposed, as shown in FIG. 5.

The phase of rolling the dice, and progressing in the game, proceeds from the upper left hand corner, and progresses downwardly, and then to the upper right hand corner, and downwardly. The board players then roll the dice sequentially according to the positions in the Round 1 tiers. Thus at the beginning, the team at Rocky Mountain 1 rolls the dice first, and then the team on the line matched with it, or that just below.

To maintain those probabilities in the present game, the special dice of FIGS. 10–13 are provided. These dice are identified as Seeded #1, Seeded #2, Seeded #3, Seeded #4, respectively, and correspond to the seeded positions (FIG. 1) 1, 2, 3, 4 of each region. Two of each kind are provided in the game for convenience.

Broadly stated, proceeding from #1 to #4, the probabilities of higher scores diminish. Specifically, die 76, #1, has 10 sides, all sides numbered, while die 78, #2, has 10 sides, with only 9 numbered, having 1 blank. Thus the probabilities are that #1 will show a higher number than #2, because in the former the numbers run higher (to 10) than in the latter (to 9).

The die 81, #3, has 8 sides, all sides numbered, but die 83, #4, has 8 sides, with only 7 sides numbered, having 1 blank. In this case the probabilities are similar to those as between the dice #1 and #2.

As between the dice 78, #2, and 81, #3, the probabilities are higher in the former than in the latter, because the numbers run higher (to 9) in the former, than (to 8) in the latter.

While the seeded teams use the seeded dice, the unseeded teams use the ordinary dice 74 (FIG. 9).

In proceeding through the tournament, each board player continues to use the same die (or dice) he used in Round 1 in every subsequent game, in tiers, 37–39.

While there is always the chance that an unseeded team will win that match, it most often happens that the seeded team wins, and this then maintains a similarity to actual or real games. As noted above, the play continues from top to bottom and after the rolling of the dice for all of the teams in the Round 1 position, the winners then place their chips showing the teams, in the Conference semi-finals tier 37, in each tier.

The seeded teams need not progress sequentially, and may be rearranged as shown on the board. After the game represented by #1 seeding and the unseeded team matched against it is determined, the next game played is that next below, with the #4 seeded team and the unseeded team positioned above it. In the case of the #4 seeded team, the #4 seeded die 83 of FIG. 13 is used. Each seeded team uses the respective seeded dice (of FIGS. 10–13) according to the seeded number, and each unseeded team rolls the regular dice 74 of FIG. 9.

In each match, each board player rolls the bracket die 86 (FIG. 14) one time only, at the same time as the first roll of the other dice. If a blank side 88 of the die turns up, the board player need not take any steps. If one of the other sides turns up, namely those with the letters R, L, or TD, he draws the top card from the corresponding pile 60, 61, 62, according to that letter. The participant then reads the instruction on the card (see FIGS. 6–8), and adds or subtracts points from his score as so instructed. For example in FIG. 6, in the REFEREE cards, there are both penalties and advances, with corresponding addition or subtraction of points in the score of the board player.

Following the foregoing, each board player rolls his playing dice two more times, for a total of three and the highest accumulated points, after all of the rolls have been made and instructions followed, wins that match and advances to the next position, eg. Conference semi-final.

The foregoing is played, in connection with one Conference, for example in the case referred to, the Rocky Mountain Conference, then the winner of that Conference is in tier 39. The play then goes to the next Conference, and in the case stated, the Ivory Coast Conference. After the play in that conference is completed, the play goes to the Islands Conference, and then the Everglades Conference.

After the foregoing, the Regional finals are played, and the winners of these then play the finals to determine the championship.

Reference is made to the appeal chips 58 referred to above. At any stage in a game, a board player may appeal a "decision" which is indicated by a roll of the dice. To so appeal, he forfeits one of the appeal chips issued to him, and then is entitled to another roll of the dice. As many appeals can be made as the number of dice issued to him, in this case three.

Figure 16:
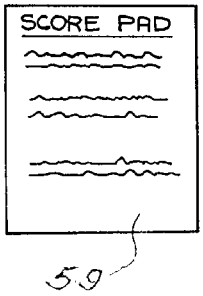
FIG. 16 shows a score pad.

After each game is completed, the board player enters his score on the score pad 58, FIG. 16. Even though a team is out of the tournament after a loss, the loser's score is entered on the score pad.

Additional rules may be provided, if decided upon before the game. In the case of ties, the winner goes to the higher seeded team. If a tie results between two unseeded teams or two equally seeded teams, each board player rolls his dice again until a winner is established.

If the sixteen seeded teams are not evenly distributed among the board players, each one rolls the regular dice 74 (FIG. 9) and the highest score(s) may pick the extra seeded position(s).

If a team gets ejected from the tournament resulting from a rule in one of the reference cards, the opposing team advances to the next position.

Still other alternate or optional rules may be utilized if decided upon in the beginning. Such other rules may include that all ties go to the lower seeded teams. Another rule may be that if sixteen seeded teams are not evenly distributed among the board players, the extra seeds are not chosen and the playing spots on the game board are used as unseeded teams. Still another rule may be that if a team gets ejected from the tournament, the previous team beaten by the ejected team now advances to the position of the ejected team and the match continues. An additional rule may be to remove the ejection card from the reference card pile.

I claim:

1. A board game comprising, a game board for use by a plurality of board players and having markings thereon including, groups of bracket team lines at opposite ends of the board, the groups being opposed to each other, and each group including an outer tier representing individual ROUND #1 team lines, and, tapering progressively inwardly toward each other toward the center of the board, additional tiers of successively lesser numbers of team lines, representing victor teams, to a center position representing a single champion team, the game also including, team pieces separate from the board, representing teams, groups of dice for rolling by the board players for establishing numbers for determining progress of the team pieces over the board in playing a game thereon between teams.

2. A board game according to claim 1 wherein, the dice including those of the different groups have different numbers of sides with numbers thereon, enabling average different scores to be attributed to respectively different teams on the same number of rolls of the dice, for thereby enabling different rates of progress of the teams through the brackets to the center champion position.

3. A board game according to claim 2 wherein, the dice include a plurality of pairs, in a least certain of the pairs, the dice of the pair have the same number of sides, and one die has an indicium on each side, and the other has at least one blank.

4. A board game according to claim 3 wherein, the indicia include numerals and letters.

5. A board game according to claim 4 wherein, in a least certain of the pairs, the indicia include only letters.

6. A board game according to claim 5 wherein, in at least certain of the pairs, the indicia include only numerals.

7. A board game according to claim 2 and including, reference cards having playing directions imprinted thereon, the dice include various sets for use at successive steps in the progress of the game, and at least certain of the sets of dice having indications thereon for the player to take a said reference card and follow the instructions in the reference card.

8. A board game according to claim 7 wherein, the dice of each set have numbers thereon to be cumulatively added to the total score number of the corresponding player, and the instructions on the reference cards refer to compliance with, and infraction of, rules and numbers to be respectively added to and subtracted from the total score numbers of the corresponding players.

9. A board game according to claim 8, wherein, the reference cards are of a plurality of categories as to content, each reference card having identifying indicia on a back side, and playing instructions on a front side, and the game board having areas thereon with identifying indicia of the reference cards, enabling the reference cards in each category, in a stack, to be placed face down in a corresponding said area.

10. A board game according to claim 2 wherein, each group of brackets at an end of the game board is made up of a plurality of Conferences equal to each other in number of team lines included therein.

11. A board game according to claim 10 wherein, the Conferences all include the same number of seeded bracket lines.

12. A board game according to claim 2 wherein, dice are rolled which indicate numbers forming scores, the game includes reference cards containing instructions drawn by the board players for the board players to follow in playing the game, and the game includes appeal chips drawn by board players for canceling, previous instructions, and establishing new and different instructions.

13. A board game according to claim 12 and including, a plurality of dice rolling cups, respectively in the shape of and depicted as paraphernalia in different sports games.

14. A board game according to claim 1 wherein, the game also includes playing pieces separate from the board, one of the playing pieces being constituted by a trophy serving as a container for other playing pieces and as a prize for the winner of the game.

15. A board game comprising, a board having markings thereon including, a group of bracket team lines at opposite ends of the board, the groups being opposed to each other, and each group including an outer tier representing individual ROUND #1 team lines, and tapering progressively inwardly toward each other toward the center of the board additional tiers of successively lesser numbers of team lines representing victor teams, to a center position representing the single champion team, a plurality of chips each representing a team, for placement on the marks in the ROUND #1 tier of team lines, certain of the team lines in the ROUND #1 tiers having seed numbers thereon, dice adapted to be rolled by each board player of the game to indicate score points attributed to each team, and the dice including first dice corresponding to seeded teams having greater odds of indicating high score points, and second dice corresponding to unseeded teams having lower odds of indicating high score points.

16. A board game according to claim 15 wherein, each die of all the dice has the same number of sides, and the first die has score indicating numbers on all the sides thereof, and the second die have score indicating numbers on less than all the sides thereof.

17. A board game according to claim 15 wherein, the team identification chips are of a plurality of groups, the chips in different groups representing actual teams in respectively different fields of sport.

18. A board game according to claim 17 and including, an additional group representing fictional names of teams in a field of sport.

19. A method of playing a game on a game board, comprising, a) providing a plurality of opposed team pieces arranged in opposed groups, pairing each team piece with another team piece wherein each said opposed group comprises a plurality of paired team pieces;

b) providing dice, said dice including different sets of dice, each set of dice having a plurality of sides bearing playing indicia, said playing indicia representing high scores and low scores, the number of sides bearing playing indicia in any one set of dice being different from any of said other sets of dice, and said sets of dice having a greater number of sides bearing more playing indicia representing high scores than said sets of dice having fewer number of sides, wherein if two different sets of dice are rolled, the set of dice having the greater number of sides bearing more playing indicia have a greater probability of producing a higher score than the set of dice having the fewer number of sides bearing less playing indicia, c) assigning a set of dice to each team piece wherein each set of dice has at least one team piece assigned to it, d) rolling said sets of dice wherein each team piece is given a score;

e) comparing the scores of each pair of team pieces wherein the team piece having the higher score wins;

f) pairing each winning team piece with another winning team piece and repeating steps d), e) and f) until only one winning team piece is left.

* * * * *